United States Patent [19]

Visser

[11] Patent Number: 5,031,436

[45] Date of Patent: Jul. 16, 1991

[54] EXTRUSION PULLING WITH DOUBLE PULLER LOCK

[75] Inventor: James T. Visser, Ada, Mich.

[73] Assignee: Granco-Clark, Inc., Belding, Mich.

[21] Appl. No.: 554,200

[22] Filed: Jul. 17, 1990

[51] Int. Cl.[5] ..... B21C 35/00

[52] U.S. Cl. ..... 72/257

[58] Field of Search ..... 72/257, 422

[56] References Cited

U.S. PATENT DOCUMENTS

| | | | |
|---|---|---|---|
| 2,893,552 | 7/1959 | Davies | 72/257 |
| 2,914,170 | 11/1959 | Kent | 72/257 |
| 3,118,539 | 1/1964 | Harwood et al. | 72/257 |
| 3,230,753 | 1/1966 | Walker | 72/257 |
| 3,585,833 | 6/1971 | Carraher | 72/257 |
| 3,587,280 | 6/1971 | Engelhardt et al. | 72/257 |
| 3,881,339 | 5/1975 | Mannell | 72/257 |
| 4,635,459 | 1/1987 | Elhaus | 72/257 |
| 4,790,167 | 12/1988 | Gentry et al. | 72/257 |
| 4,873,857 | 10/1989 | Giancarlo | 72/257 |

FOREIGN PATENT DOCUMENTS

| | | | |
|---|---|---|---|
| 2524372 | 12/1976 | Fed. Rep. of Germany | 72/257 |
| 3040236 | 5/1982 | Fed. Rep. of Germany | 72/257 |

OTHER PUBLICATIONS

EP 300,262, pub. May 7, 1988, Patentee: Groos.

*Primary Examiner*—Robert L. Spruill

*Attorney, Agent, or Firm*—Varnum, Riddering, Schmidt & Howlett

[57] ABSTRACT

A method and apparatus for removing an extruded profile shape from an extrusion press efficiently and economically during an extrusion operation. A first and second extrusion puller are mounted on suitable guide for movement along an extrusion line. One of the extrusion pullers receives and grips a profile shape as it is extruded from an extrusion press, and this puller exerts a pulling force on the profile shape. The first puller can pass off the profile shape to the second puller as the profile shape is extruded, thereafter the second puller would grip and pull the profile shape and the first puller would release its grip. When it is desired, or necessary to remove the profile shape from the extrusion press, the puller which is not gripping the shape grips the profile shape and a shear within the press shears off a butt portion of the billet. Then, both pullers, in tandem, apply a pulling force on the profile shape away from the extrusion press. The profile shape is stripped from the die. Thereafter, the first puller releases its grip and returns to receive another profile shape while the second puller moves the profile shape to further conditioning operations. Finally, the second puller returns to its home position and waits to receive the next extruded profile shape.

10 Claims, 12 Drawing Sheets

EXTRUSION PULLING WITH DOUBLE PULLER LOCK

TECHNICAL FIELD

This invention relates to extrusion pulling and, more, particularly, to extrusion pulling wherein a pair of pullers are programmed to operate in tandem for efficient removal of the extruded workpiece from the extrusion die.

BACKGROUND OF THE INVENTION

In the extrusion of profile shapes by forcing metal billets through an extrusion die, the profile shapes are typically subjected to conditioning operations and other mechanical operations such as straightening and shearing to a specified length immediately following extrusion. A known extrusion operation begins when a heated billet is placed into the extrusion press and force is applied to one end of the billet, extruding it through an appropriate die. After a small amount of the billet is extruded through the die to form a profile shape, the profile shape is gripped by a suitable gripper mechanism. After sufficient gripping is achieved, the ram of the extrusion press continues to force the metal billet through the extrusion die as an extrusion puller grips the profile shape and applies a pulling force in the direction of the extrusion axis. When substantially all of the billet has been extruded, the ram of the press ceases its forward movement toward the die. Likewise, the gripper ceases its application of pulling force on the profile shapes. At this point, a shear within the press passes across the rear face of the die to shear the butt portion of the billet from the portion of the billet remaining in the die. Thereafter, a new billet is loaded into the press and the extrusion puller and ram may once again apply force to the profile shape to either remove it from the die or continue the extrusion operation.

An important limitation in this process is the requirement that the extrusion puller stop the progress of the profile shape from the extrusion press to the cooling and other conditioning operations while the new billet is loaded into the press and force from the ram is reapplied to the profile shape. This waiting time reduces the overall efficiency of the extrusion operation. It would be more efficient to minimize the time in which the progress of the profile shape from the press to the further conditioning operations is stopped and to speed the return movement of the extrusion puller to prepare for the next extrusion operation.

The U.S. Pat. to Gentry, et al., No. 4,790,167 (issued Dec. 13, 1988) and the U.S. Pat. to Anderson, No. 3,157,268 (issued Nov. 17, 1964) both disclose extrusion handling equipment for conditioning extrusions upon removal of the profile shape from the press. It is known to incorporate such conditioning and handling equipment in the extrusion apparatus to provide for efficient movement of the extrusions away from the extrusion pulling apparatus. Such extrusion handling equipment may include various conditioning means such as a quench tank or spray of cooling medium for quenching the hot extruded profiles. However, uniform properties throughout the profile shapes are not achieved when the progress of the puller and the profile shape must be stopped to load the next billet to allow the profile shape to be separated from the extrusion press. For example, if the quenching means incorporated are spray nozzles directed on the profile shapes immediately after exiting the extrusion die, a portion of the profile shape will be subjected to an excessive amount of quenching medium while the extrusion puller stops to wait for loading of the next billet and reapplication of force from the ram. Likewise, if the quenching medium is a quench tank, the temperature differential between the first extruded end of the profile shape and the last extruded end of the profile shape will be much greater if the progress of the profile shapes toward the quench tank is halted while the next billet is loaded into the billet cavity. These temperature differentials will result in undesirable unequal properties throughout the length of the profile shape.

It is well known to incorporate a single puller head in the extrusion apparatus. Examples of such single puller head extrusion apparatus are disclosed in the U.S. Pat. No. 4,628,719 to Best (Dec. 16, 1986), U.S. Pat. No. 4,307,597 to Elhaus, et al., (Dec. 29, 1981), U.S. Pat. No. 3,881,339 to Mannell (May 6, 1975), and U.S. Pat. No. 3,230,753 to Walker (Jan. 25, 1966).

SUMMARY OF THE INVENTION

The invention comprises the method and apparatus for removing an extruded profile shape from the extrusion press efficiently and economically during an extrusion operation. The apparatus of the invention comprises a first and second extrusion puller, control means, and an extrusion press. The extrusion press comprises a billet cavity with two ends, a first end, which is closed by a die, and an open second end. Moveable within this billet cavity is a ram, the ram moves between a loading position at the open second end of the cavity and an extended position adjacent to the die wherein a butt end of a billet remains in the billet cavity and the die when the ram reaches this extended position. The extrusion press also includes a shear means for severing the butt of the billet. An extrusion run-out table is incorporated such that it extends from the extrusion press along the extrusion line and it is adapted to support the profile shapes as they are extruded from the press. The profile shapes are gripped by a first and second extrusion puller which pull the profile shapes from the extrusion press along the extrusion line. Control means control the operation of the first and second extrusion pullers to actuate the first and second extrusion pullers to simultaneously grip and pull the profile shapes to strip them from the die.

The control means may include means to control the force applied by the extrusion ram on the billet and means to control the first and second extrusion pullers to grip the profile shapes in response to the application of the force of the ram. In addition, the first and second pullers can be controlled so that only one of the pullers grips and pulls the profile shapes until it is desirable to separate the profile shapes from the billet.

The invention further comprises a method for extruding profile shapes from an extrusion press wherein the shapes are extruded from a billet through a die opening by a ram within a billet cavity in the press. The ram is moved from a receiving position to an extended position near the die opening during the extrusion process. A butt end of the billet remains in the die when the ram reaches the extended position. The butt is sheared off by a shear within the press. The profile shapes are gripped by a pair of extrusion pullers and pulled with such force that the profile shape is stripped from the die.

The profile shape can be pulled from the die with only one of the two pullers as the ram extrudes the profile shapes through the die. The first puller can pass off the profile shape to the second puller during the extrusion. As the profile shape is passed off, the second puller grips the shape and applies pulling force while the first puller releases its grip on the profile shape. The puller which is not pulling the shape during the extrusion grips the profile shape when it is desired to strip the profile shape from the die. Both pullers, in tandem, apply pulling force to the shape and strip it from the die. After the profile shape has been stripped from the die, the first puller can release its grip on the shape and move to its home position, adjacent to the die opening. As this first puller releases its grip and moves to its home position, the second puller continues to pull the profile shape away from the die opening of the press. Finally, the second puller releases its grip on the profile shape and moves to its home position and prepares for another extrusion operation.

The invention accomplishes several efficiencies in the extrusion operation not found in the prior art. First, through the incorporation of two pullers, the pulling apparatus has sufficient capacity to strip the profile shapes from the die without the application of force from the ram. Use of two lightweight pullers create a more responsive and versatile pulling apparatus than the incorporation of a single massive puller with sufficient pulling capabilities. In addition, through the coordination of the two pullers, a more efficient extrusion operation is achieved. After the profile shape is stripped from the press, the first puller can return to the receiving position and prepare for the next extrusion operation as the second puller transfers the extrusion to the extrusion handling apparatus for further conditioning. The next extrusion cycle can begin immediately after the first puller returns to the receiving position as the second puller transfers the profile shape for further operations.

Other advantages of this invention are readily apparent when the profile shapes are quenched immediately upon extrusion from the press. For example, if spray heads for directing suitable cooling means against the profile shapes are located immediately adjacent the extrusion die, the profile shape will be subjected to an even flow of the quenching spray because the progress of the extrusion is not stopped to wait for a new billet to be loaded into the press. Equal application of the quenching spray results in equal properties throughout the profile shape. In addition, if a quench tank is incorporated into the conditioning apparatus such that the profile shapes are placed into the tank when stripped from the press, then continuously pulling the shapes from the die results in a minimal temperature differential between the first extruded portion of the profile shape and the last extruded portion of the profile shape. This minimal temperature differential produces more uniform properties throughout the length of the profile shape.

BRIEF DESCRIPTION OF DRAWINGS

The invention will now be described in detail with reference to the accompanying drawings wherein:

FIG. 14 is a side elevational view of the double puller in conjunction with quenching means.

DESCRIPTION OF THE PREFERRED EMBODIMENT

There are numerous designs for extrusion puller apparatus, such as the designs disclosed in the U.S. Pat. to Mannell, No. 3,881,339 (issued May 6, 1975), the U.S. Pat. to Best, No. 4,628,719 (issued Dec. 16, 1986), and in the pending U.S. Pat. application by Visser Ser. No., 438,574, filed Nov. 16, 1989 now U.S. Pat. No. 4,953,381. In these designs, a single extrusion puller is mounted on suitable guide means or rails for guiding and supporting the extrusion puller during an extrusion operation. This invention is suitable for use in any number of extrusion puller designs including those disclosed above. For example, in the Visser Patent, U.S. Pat. No. 4,953,381, a pulling apparatus is disclosed wherein a material to be pulled is forced through an extrusion press and gripped by an extrusion puller. The extrusion puller is driven away from the extrusion press along the extrusion axis which corresponds to the longitudinal axis of the run-out table. The extruded shapes are supported by the run-out table. After the extrusion is completed, the extruded shapes are transferred from the run-out table to a cooling table for further processing. Although many different cooling and run-out tables are possible, the table disclosed in the U.S. Pat. to Gentry, et al., No. 4,790,167 (issued Dec. 13, 1988) is expressly incorporated herein by reference.

Figure 1:
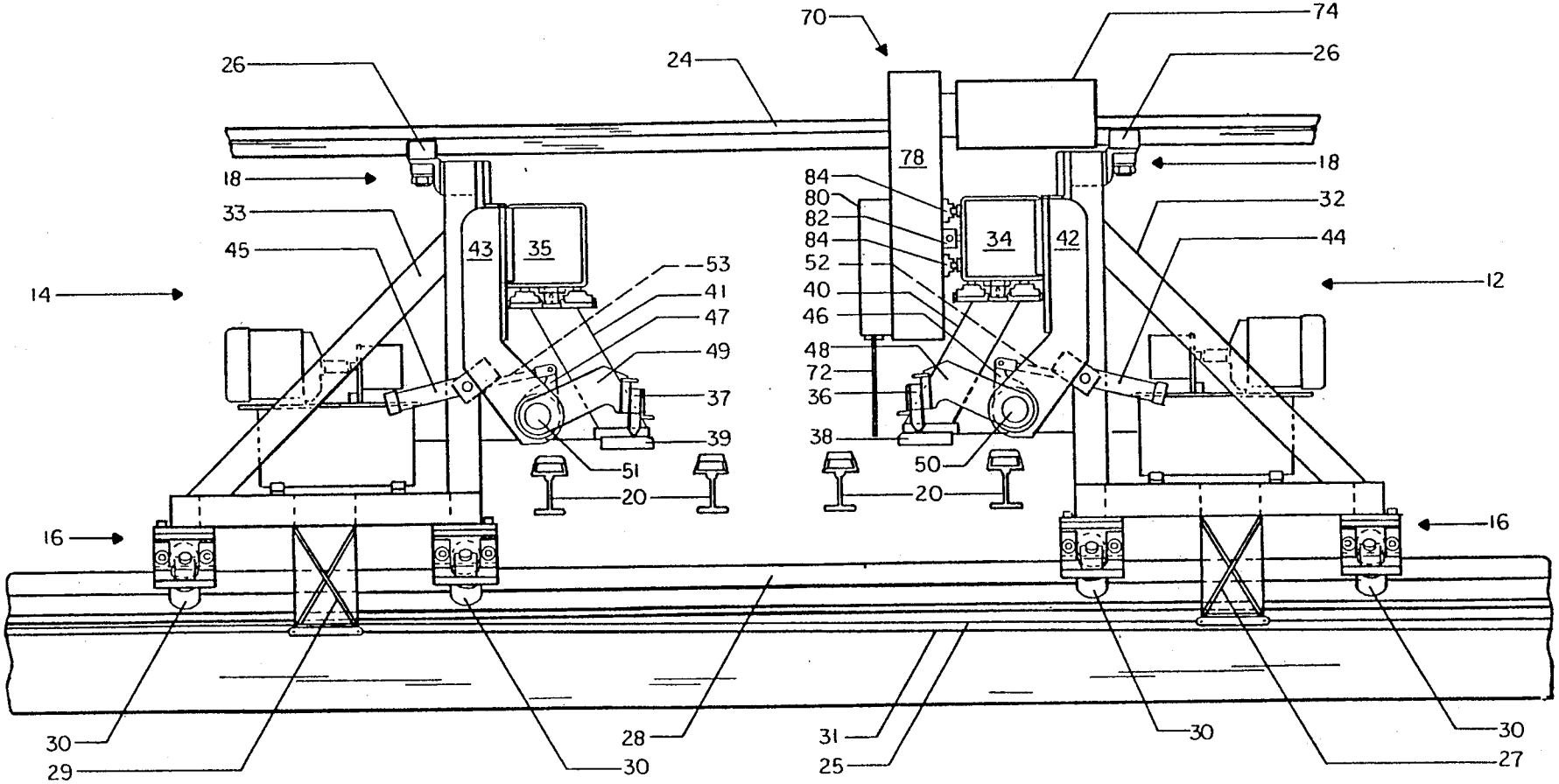
FIG. 1 is a side elevational view of an extrusion puller according to the invention.
Figure 2:
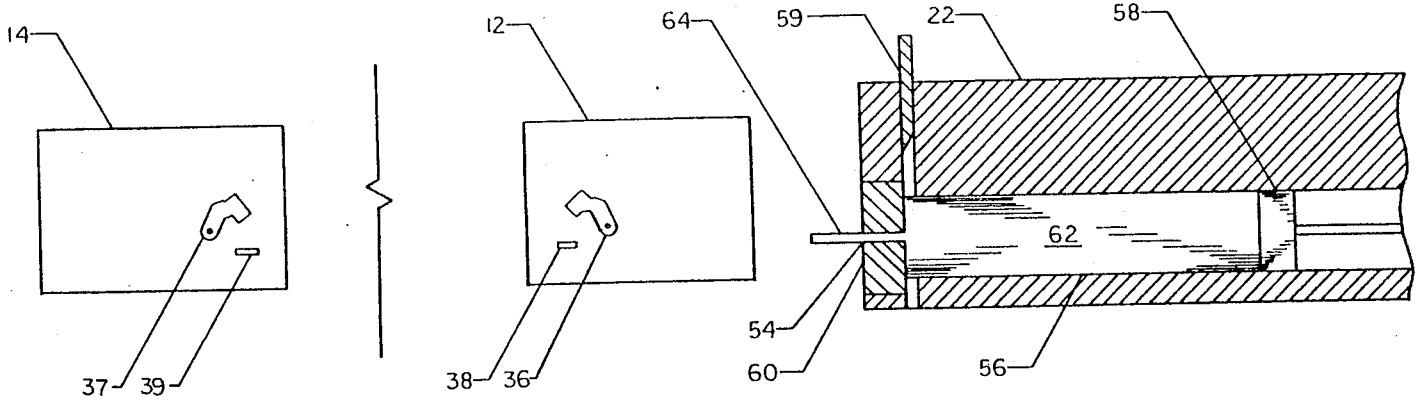
FIG. 2 is a schematic view of the double puller shown in FIG. 1 and an extrusion press at the beginning of a new extrusion cycle.

Referring to FIG. 1, a first extrusion puller 12 and a second extrusion puller 14 are mounted on a lower guide means 16 and an upper guide means 18 for movement along a run-out table 20 from an extrusion press 22 (FIG. 2). In the preferred embodiment, both the first and second pullers are mounted on the same guide means, 16 and 18. It is certainly possible to use separate guide means for each puller if desired.

The lower and upper guide means, 16 and 18, can have different configurations. The upper guide means comprises a T-shaped beam 24 and a pair of rollers 26. The lower guide means comprises a hexagonal beam 28 and a plurality of rollers 30. The T-shaped beam 24 and the hexagonal beam 28 extend along the extrusion axis and provide support and guidance for the pullers.

The first and second pullers, 12 and 14, essentially comprise the same elements merely assembled in a mirror configuration. Therefore, the following description will apply to both the first puller 12 and the second puller 14. Numerical references for elements of the second puller 14 will be contained in parentheses immediately following corresponding elements on the first puller 12.

The drive means for moving the puller 12 (14) along the extrusion axis comprises a drive means mounting 27 (29), an endless drive chain 25 (31), a drive motor 68 (69) (FIG. 12) and a pair of sprockets (not shown). The chain 25 (31) is fixed to the drive means mounting 27 (29) and is wound around the sprockets and is driven by the motor (not shown in FIG. 1) through one of the sprockets. The drive motor 68 (69) (FIG. 12) comprises a reversible motor which drives the puller sprocket to impart rotation of the motor to the chain 25 (31). Through the cooperation of the sprockets (not shown) and the drive motor 68 (69) (FIG. 12), each puller 12 or 14 can move independent of the other along the upper and lower guide means, 16 and 18.

The first and second pullers comprise a support frame, 32 (33), a jaw support beam 34 (35), an upper jaw 36 (37), and a lower jaw 38 (39). The jaw support beam 34 (35) is fixedly attached to the support frame 32 (33) such that one end of the support beam 34 (35) extends over a portion of the run-out table 20. Fixedly attached to this end of the support beam 34 (35) is a mounting arm 40 (41) for the lower jaw 38 (39). Also attached to this end of the support beam 34 (35) is a mounting arm 42 (43) for the upper jaw 36 (37). One end of the mounting arm 42 (43) is fixedly attached to the support beam 34 (35) whereas the other end of the arm 42 (43) extends to a point adjacent the lower jaw 38 (39). Fixedly attached to this other end of the mounting arm 42 (43) are pivot means which comprise a hydraulic cylinder 44 (45), a first pivot arm 46 (47), a second pivot arm 48 (49), a pivot point 50 (51) and a crank arm 52 (53). The upper jaw 36 (37) is fixedly attached to one end of the second pivot arm 48 (49) whereas the other end of the arm 48 (49) is fixedly attached to the pivot point 50 (51). One end of the first pivot arm 46 (47) is fixedly attached to the pivot point 50 (51) whereas the other end is pivotally attached to a crank arm 52 (53) of the hydraulic cylinder 44 (45).

Figure 10:
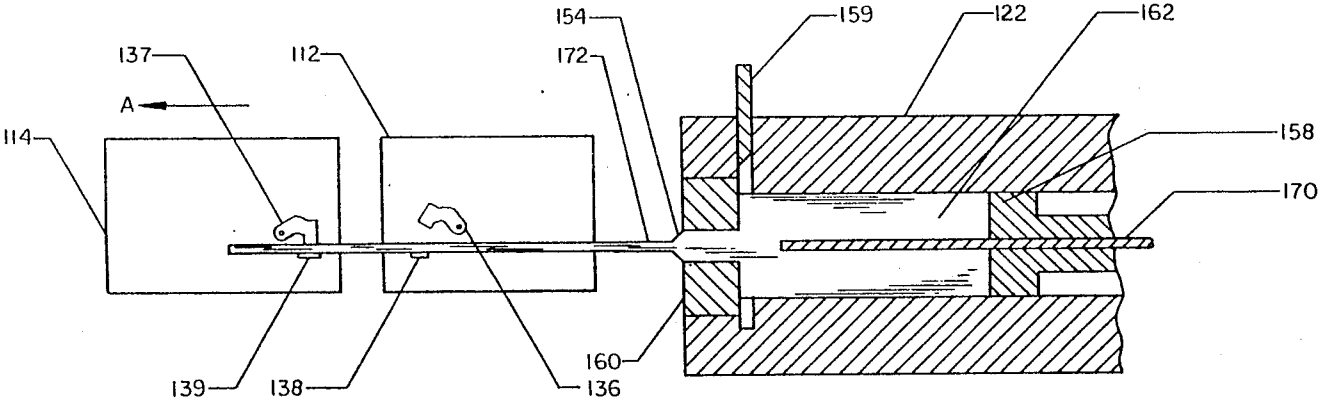
FIG. 10 is a schematic view in section of the double puller shown in FIG. 2 with a piercing die incorporated therein.

As the crank arm 52 (53) is extended from and retracted into the hydraulic cylinder 44 (45), the first and second pivot arms 46 (47) and 48 (49) pivot about the pivot point 50 (51), thereby moving the upper jaw 36 (37) relative to the lower jaw 38 (39). Sufficient force can be applied from the hydraulic cylinder 44 (45) to the pivot arms to create adequate gripping pressure between the upper jaw 36 (37) and lower jaw 38 (39) to grip an extruded profile shape 64 during an extrusion pulling operation. The hydraulic cylinders 44 and 45 of the first extrusion puller 12 and second extrusion puller 14 can operate independently of each other or in concert with each other by suitable control means (FIG. 10).

A saw 70 can also be incorporated onto one of the pullers to cut the extruded profiles 64 during the extrusion operation. The saw comprises a saw blade 72, a saw motor 74, and means for transverse movement of the saw with respect to the extrusion line. The saw motor 74 rotationally drives the saw blade 72 by a belt (not shown) which is mounted to a motor pulley (not shown) and a saw blade pulley (not shown). The pulley and belts are contained within a belt housing 78. One-half of the saw blade 72 is contained within a blade guard 80 to provide safety from the moving blade. The means for transverse movement of the saw comprise a hydraulic cylinder 82, one end of which is mounted to the belt housing 78 and the other end which is mounted to the jaw support beam 34. The movement of the saw 70 is guided by a track and bearing assembly 84. As the push rod (not shown) of the hydraulic cylinder 82 is extended and withdrawn into the cylinder, the saw 70 moves back and forth across the extrusion line so that when the saw motor 74 is engaged, the saw blade 72 cuts the extrusion during the extrusion operation.

Referring now to FIG. 2, the first puller 12, second puller 14 and extrusion press 22 are schematically shown. The extrusion press 22 comprises a die opening 54, a billet cavity 56, a ram 58, a shear 59 and extrusion die 60. A billet 62 is inserted into the billet cavity 56 and force is applied by the ram 58 to extrude the billet 62 through the extrusion die 60 creating the extruded profile shape 64. The extrusion die may produce several different configurations of profile shapes.

At the beginning of an extrusion cycle, the first puller 12 is at its home position, adjacent to the extrusion die 60 and the second puller 14 is at its home position at a point approximately half-way down the extrusion axis. As seen in FIG. 2, both upper jaws 36 and 37 are pivoted upward in the "receiving" position. The extrusion operation begins when the ram 58 applies sufficient force to the billet 62 and begins to force material out of the extrusion die 60 thereby creating the profile shape 64.

Figure 3:
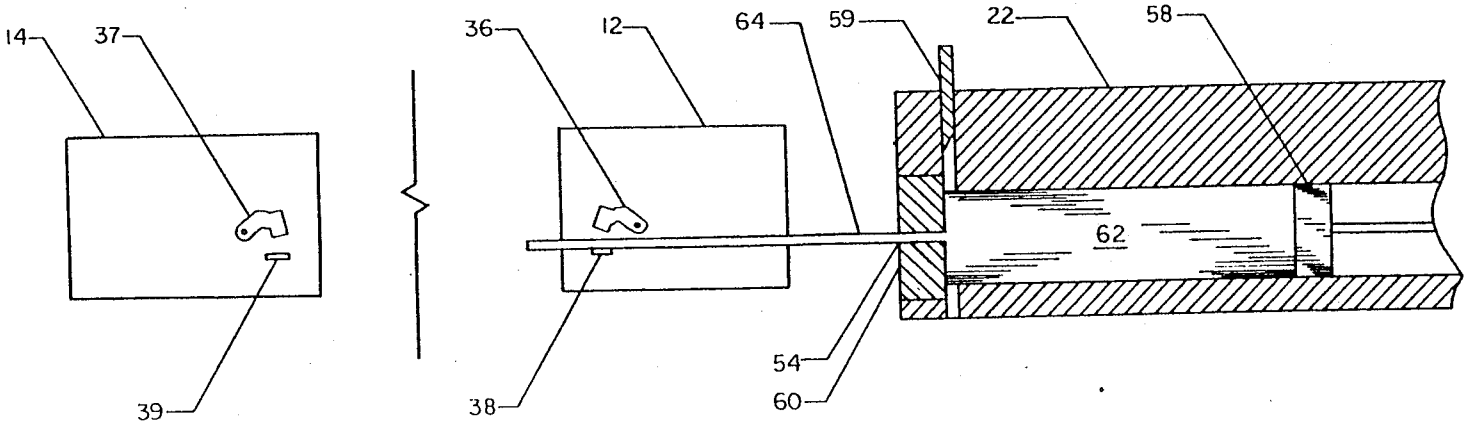
FIG. 3 is a schematic view of the double puller and extrusion press similar to FIG. 2, but in the loading state.
Figure 4:
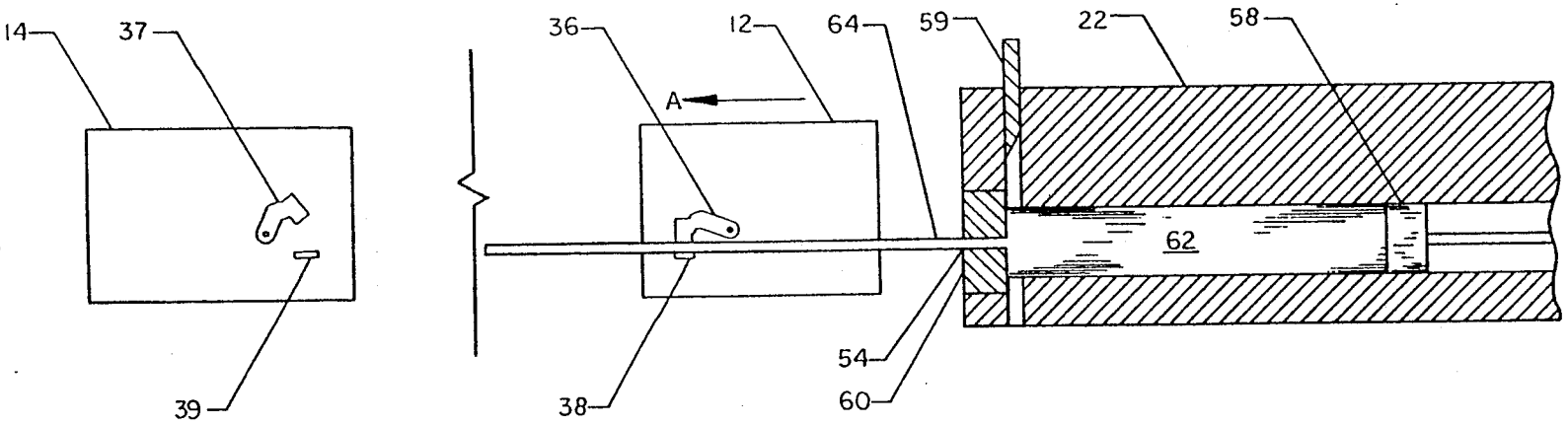
FIG. 4 is a schematic view of the double puller and extrusion press similar to FIG. 2, but in the gripping state.
Figure 12:
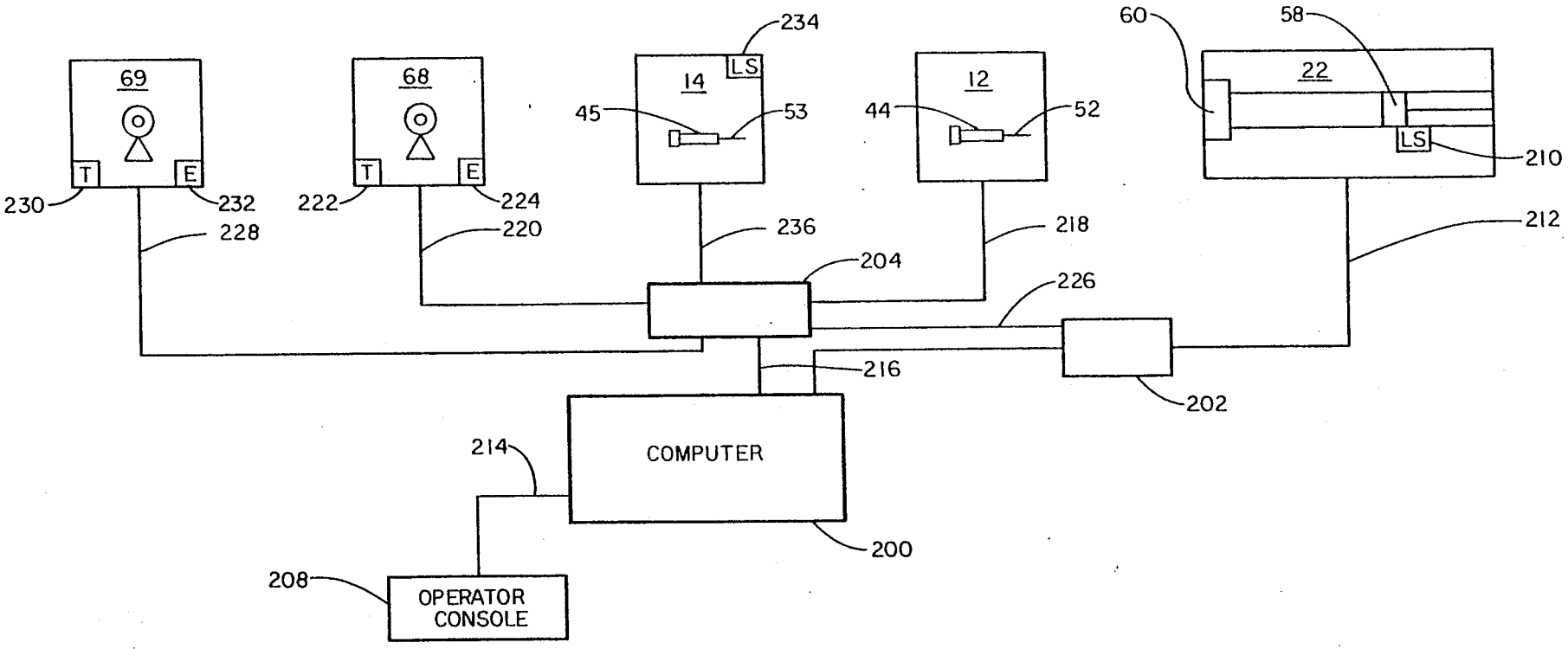
FIG. 12 is a schematic representation of a control system to operate the extrusion puller apparatus according to the invention.

As seen in FIG. 3, the upper jaw 36 is still in the receiving position. After a sufficient length of the shape 64 has been extruded such that it is supported by the lower jaw 38, the upper jaw 36 pivots downward into the "gripping" state as seen in FIG. 4. The action of the upper jaws can be controlled either manually by an operator or through a suitable numerical control system (FIG. 12). A sufficient amount of gripping pressure is applied to the profile shape 64 by the upper jaw 36 and lower jaw 38 so that the puller 12 can work with the ram 58 and pull the profile shapes 64 as they are extruded from the die 60.

Figure 5:
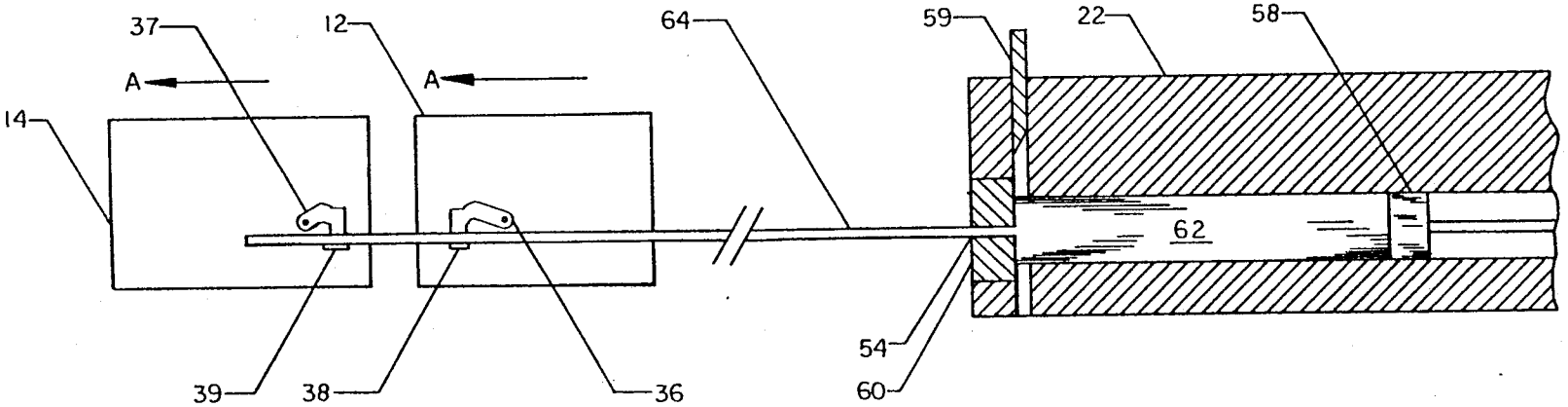
FIG. 5 is a schematic view of the double puller and extrusion press similar to FIG. 2, but showing the passing off of the profile shape.

As seen in FIG. 5, the extrusion operation continues by the combined pulling force of the extrusion puller 12 and the pushing force of the ram 58 until approximately one-half of the profile shape 64 has been extruded. At this point, the first puller "passes off" the profile shape 64 to the second puller. As the first puller 12 travels down the extrusion line and nears the half-way point, the second puller 14 is engaged such that it approaches the first puller 12. When the first and second pullers, 12 and 14, are adjacent to each other and moving in the same direction at the same speed, the profile shape 64 is passed off. The upper and lower jaw, 37 and 39, of the second puller 14 grip on the profile shape 64. Once the profile shape 64 is gripped by the second puller 14, the drive means for the second puller (FIG. 12) begins to apply pulling force to the profile shape 64. At this instant, the upper and lower jaw, 36 and 38, of the first puller 12 release their grip on the profile shape 64. For a brief instant both pullers are gripping and pulling the profile shape, as shown in FIG. 5.

During the passing off operation, the ram 58 does not alter the pressure applied to the billet 62 within the press 22. Thereafter, the second puller 14 provides the pulling force in the direction of arrow A for the remainder of the pulling operation. Depending upon the requirements for the particular extrusion operation, the first puller 12 may either reverse direction and return to its home position or may trial along behind the second puller 14 to aid in removing the profile shape 64 from the extrusion die 60. Although the preferred embodiment passes the profile shape from the first puller 12 to the second 14 at the half-way point of the extrusion, this exchange may be performed anywhere along the extrusion line depending upon the extrusion operation or may not be performed at all until the profile shape is stripped from the die 60.

Figure 6:
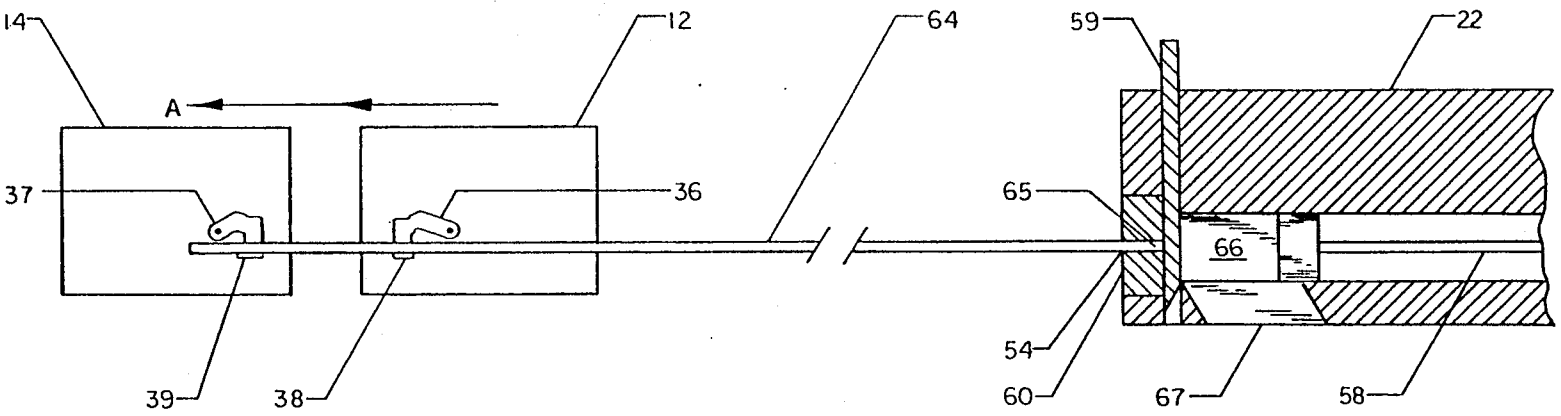
FIG. 6 is a schematic view of the double puller and extrusion press similar to FIG. 2, but during the stripping operation.

As seen in FIG. 6, the end of an extrusion cycle is reached when substantially all of a billet 63 has been forced through the extrusion die 60. The remaining end of the billet, a butt 66, frequently contains a large amount of scale, dirt and other impurities from the original billet 62 or impurities introduced during the extrusion operation by such substances as lubricants. Obviously, it is desirable to keep these impurities out of the profile shape 64. Therefore, the butt 66 is sheared of within the extrusion press 22 by a shear 59 and is scrap. When it is desireable to shear off the butt 66, the ram 58 ceases applying pushing force to the billet 62 and the second puller 14 ceases application of pulling force along the extrusion line. Thereafter, the shear 59 is engaged to sever the butt portion 66 of the billet 62 from a portion of the first billet which remains in the die 65. The butt portion 66 is removed from the billet cavity 56 by means of an opening 67 in the billet cavity. After the shear 59 has separated the butt portion 66, the butt portion 66 falls, by the force of gravity, through the opening 67 on to a scrap conveyor (not shown) and is removed from the extrusion operation.

At this point in the operation, various alternatives exist. The profile shape 64 may be stripped immediately from the extrusion die and transferred to further conditioning operations, or a second billet may be loaded and extruded, forcing the portion of the first billet 65 which remains in the die out of the die 60 so that the second puller 14 may transfer the profile shape 64 to the cooling and handling systems. Unfortunately, this second alternative requires stopping the puller 14 while a new billet is loaded.

When it is desired or becomes necessary to remove the profile shapes 64 from the die 60, the first and second pullers, 12 and 14, are used simultaneously in tandem to strip the profile shape 64 form the die 60. As seen in FIG. 6, this operation is completed by causing the first puller to grip the profile shape and apply pulling force in the direction of arrow A by both pullers 12 and 14 without any pushing force applied by the ram 58. With only the pulling force from the pullers 12 and 14, the portion of the billet in the die 65 is stripped out of the die 60. The combined pulling force of both pullers 12 and 14 is sufficient to remove the profile shape from the die so that two smaller, less powerful pullers can be used rather than a single large powerful puller.

Figure 7:
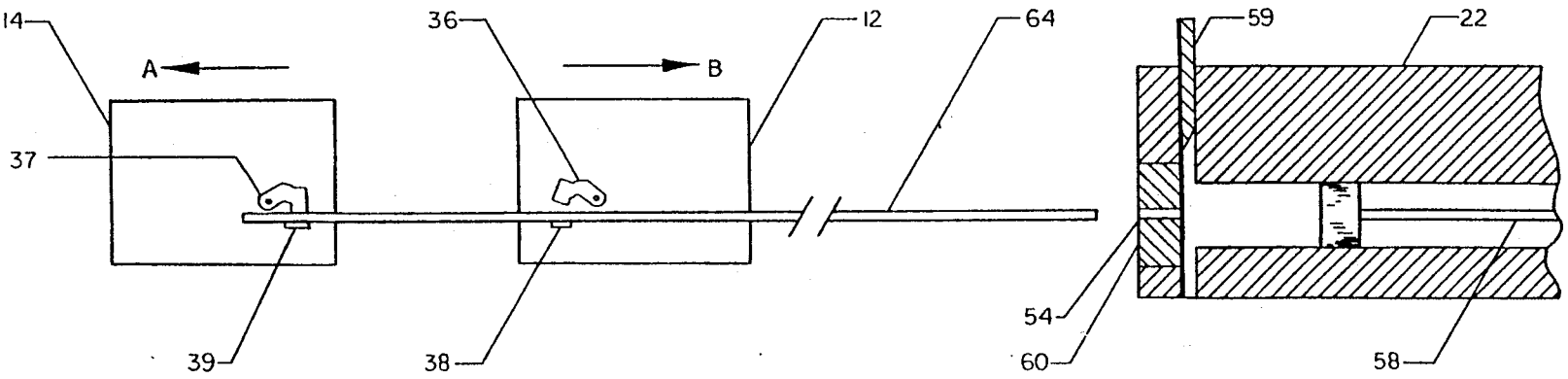
FIG. 7 is a schematic view of the double puller and extrusion press similar to FIG. 2, but during the transfer operation.
Figure 8:
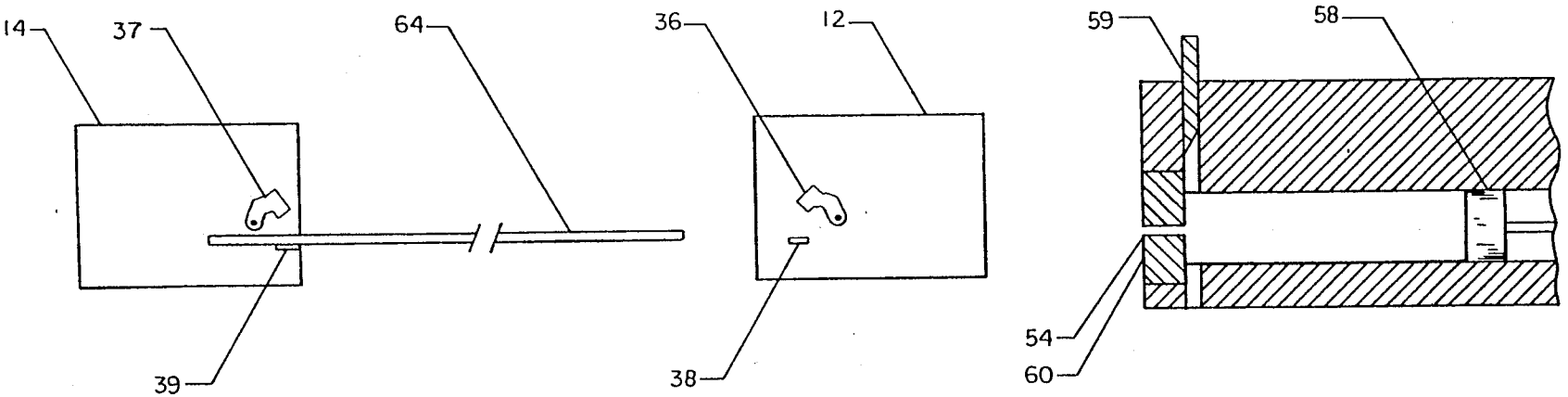
FIG. 8 is a schematic view of the double puller and extrusion press similar to FIG. 2, but in the release state.
Figure 9:
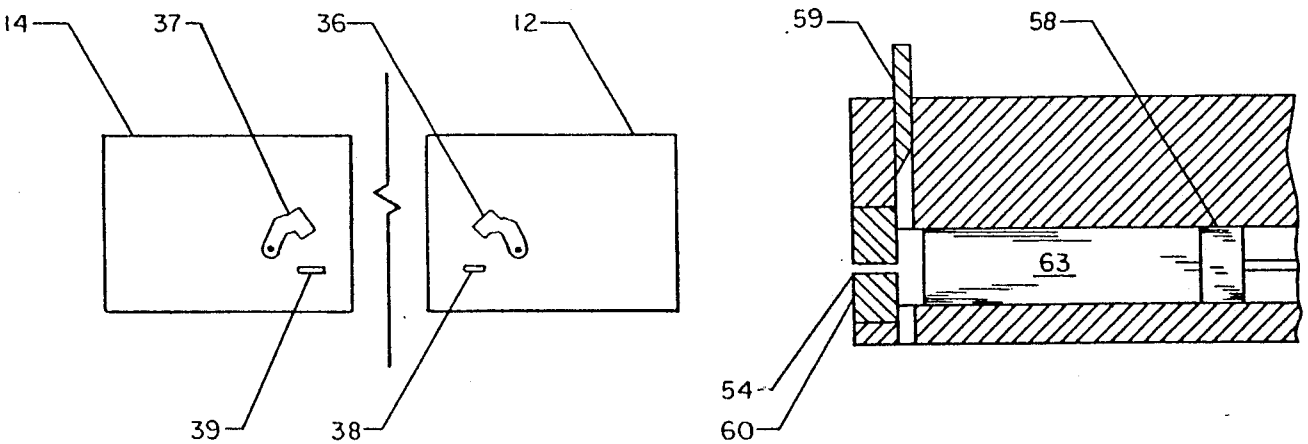
FIG. 9 is a schematic view of the double puller and extrusion press similar to FIG. 2, but in the return position, ready to receive another extrusion from the press.

Use of two pullers, 12 and 14, instead of one creates a faster, more efficient extrusion operation. As seen in FIG. 7, after the profile shape 64 is stripped from the press 22, the first puller 12, releases its grip on the profile shape 64 created by the upper and lower jaws 36 and 38. Then, the first puller 12 moves independently of the second puller 14 and returns to prepare for another extrusion operation. The second puller 14 continues to pull the extrusion along the run-out table 20 (FIG. 1) to a position where the profile shape 64 can be transferred from the run-out table 20 (FIG. 1) to a cooling table (not shown) for further operations. Once this transfer position is reached, the second puller 14 stops its movement and releases the grip created by the upper and lower jaws 37 and 39. This condition is shown in FIG. 8. The second puller 14 can now return to its home position and prepare for the next extrusion operation. Meanwhile, the first puller 12 stands ready to receive the next extrusion. As seen in FIG. 9, a new extrusion operation can commence after the profile shape 64 has been stripped, and a second billet 63 has been loaded into the billet cavity 56.

The necessity of removing the profile shape 64 from the press 22 by the action of the pullers, 12 and 14, depends upon the extrusion operation being conducted. Whenever it is necessary to change the extrusion die 60, the pullers 12 and 14 can be used to strip the profile shape 64 from the die 60. In addition, whenever it is desired to terminate the operation of the press 22, the pullers, 12 and 14, can be used to strip the profile shape 64 from the die 60.

The tandem pulling ability of the pullers 12 and 14 is also useful when a piercing die is incorporated. As seen in FIG. 10, a piercing die is utilized for extruding long, hollow shapes, and is easily incorporated into the extrusion press of the first embodiment. Like numerals shall be utilized for analogous components, but shall be increased by 100. An extrusion press 122 comprises a billet cavity 156, a ram 158, a shear 159, a die 160, a die opening 154 and a mandrel 170. The mandrel 170 is telescopically mounted on the center line along and within the ram 158 and may move independently thereof.

In operation, a heated billet 162 is loaded into the press 122 and a first puller 112 and a second puller 114 are at their home positions, a point adjacent to the die 160. The operation begins when the mandrel 170 applies force to the billet 162. As seen in FIG. 10, the mandrel 170 is of smaller cross-section than the die opening 154. Therefore, only the center portion of the billet, known as a slug 172, is forced out of the press 122. After a short portion of the slug 172 has been extruded, the second puller 114 grips the slug and begins to apply a pulling force along the extrusion line. When substantially all of the slug 172 has been forced from the press 122 by the mandrel 170, the ram 158 begins to force the remaining portion of the billet 162 out of the die opening 154, thereby forming a seamless tube.

Figure 11:
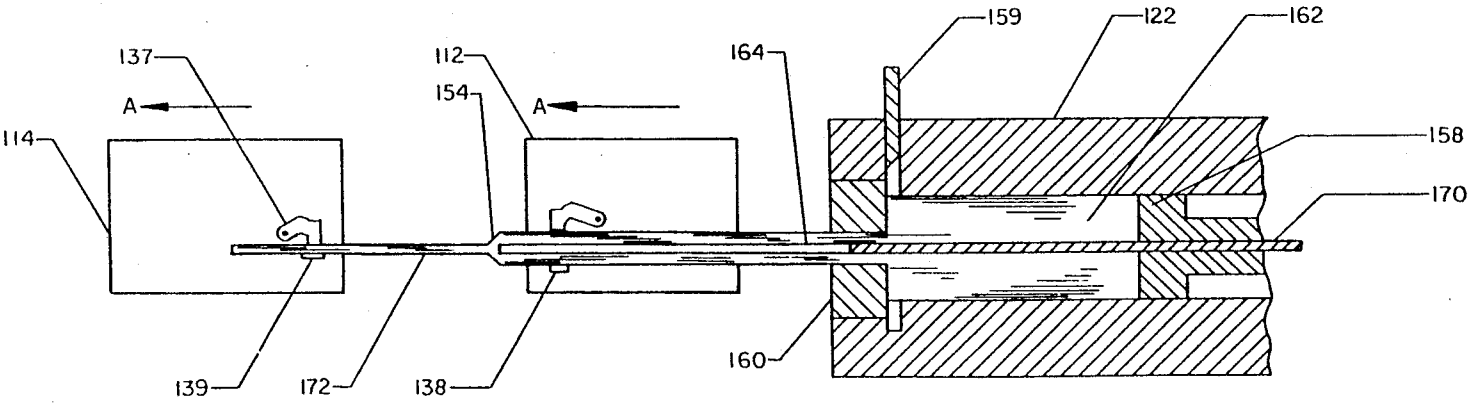
FIG. 11 is a schematic view in section of the double puller similar to FIG. 10 during an extrusion operation.

As seen in FIG. 11, while the ram 158 extrudes the billet 162, the mandrel remains within the die 160 such that the extruded profile shape 164 is hollow. After a short portion of the profile shape 164 has been extruded, the first puller 112 grips the profile shape 164. A saw 70 (FIG. 1) mounted on the first puller 112 severs the slug 172 from the profile shape 164. The second puller 114 thereafter transfers the slug to a suitable waste conveyor (not shown) and awaits the passing off of the profile shape 164 from the first puller 112. Thereafter, the first and second puller can operate in tandem, as described in the first embodiment, to efficiently strip the profile shape 164 from the extrusion press 122 and transfer it to further conditioning and quenching operations. In piercing dies, the cross section of the profile shape 164 is typically large. Therefore, it is usually necessary to use the first and second pullers, 112 and 114, in tandem to strip the shape 164 from the die 160.

The control system of the extrusion apparatus will be described with reference to FIGS. 12 and 13*a–e* which are a schematic representation of a control system for operating the extrusion pullers and a flow chart of the operations according to the invention. Like numerals have been used to designate like parts. In FIG. 13*a–e*, P1 is a shorthand notation for the first puller and P2 is a shorthand notation for the second puller.

The entire operation is monitored by a cell controller computer 200 which interacts with programmable controllers on the various components such as a press controller 202 and a puller controller 204. The cell controller computer 200 also receives input from an operator console 208.

Figure 13A:
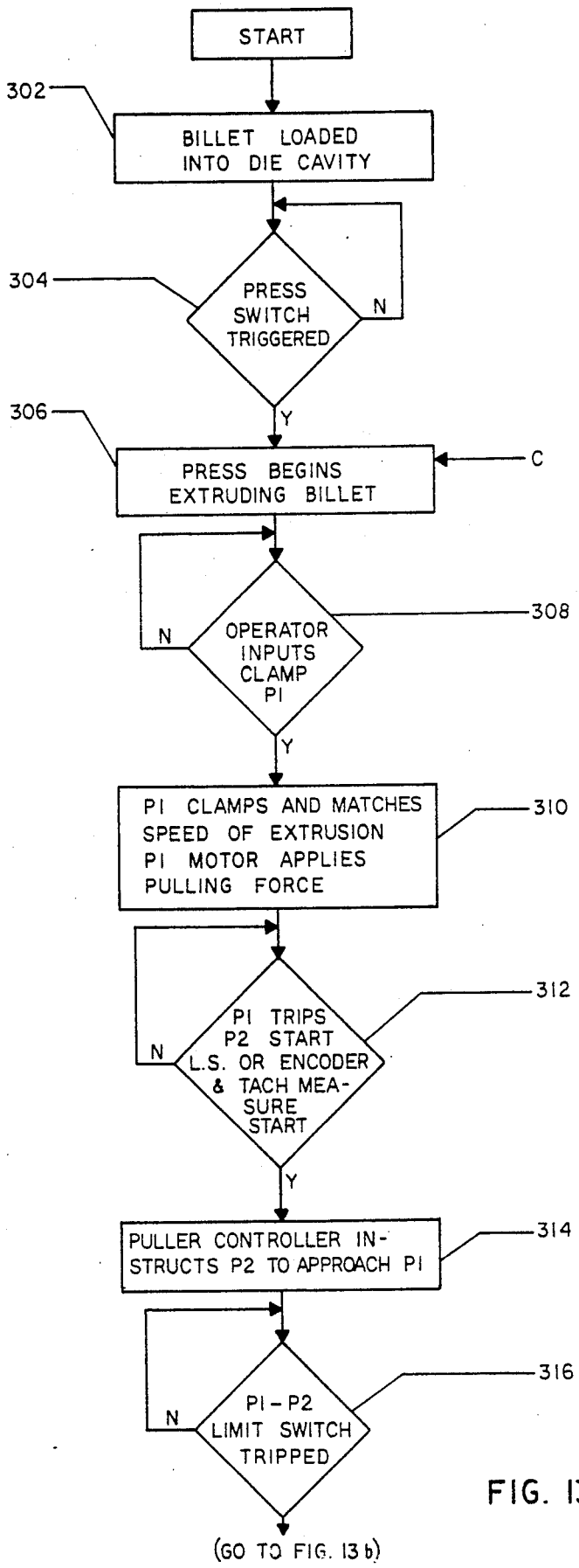
FIG. 13*a–e* are is a flow chart of the extrusion pulling operation according to the invention.

The operation begins when a billet 62 enters the billet cavity 56 (block 302 of FIG. 13*a*). When the billet is fully loaded into the press, a limit switch 210 is triggered and a signal is sent to the press controller 202 through a control line 212 (block 304 of FIG. 13*a*). Thereafter, the press controller 202 transmits a signal to the press 22 to begin extruding the billet 62, (block 306 of FIG. 13*a*), through control line 212 and a signal to the puller controller 204 through a control line 226 that the operation has begun.

After a short amount of the profile shape 64 has been extruded through the die 60, the operator inputs a clamp signal into the operator console 208 (block 308 of FIG. 13*a*). The cell computer 200 and operator console send and receive signals between each other through a control line 214. The cell controller computer 200 transmits a signal to the puller controller 204 through a control line 216 to clamp the jaws, 36 and 38. The puller controller 204 transmits a signal to the hydraulic cylinder 44 of the first puller 12 to clamp the extrusion through a control line 218. The hydraulic cylinder 44 causes the jaws, 36 and 38, to grip the extrusion. In addition, the puller controller 204 transmits a signal to the first puller motor 68 through a control line 220 to match the speed of the extrusion and begin applying pulling force, (block 310 of FIG. 13*a*).

The movement of the first puller 12 is tracked and measured through the puller controller 204 by a tachometer 222 and an encoder 224 incorporated in the first puller drive motor 68. The measurements and readings of the tachometer 222 and encoder 224 are communicated to the puller controller 204 through control line 220. When the first puller has travelled a sufficient distance along the extrusion line, as measured by the encoder 224, it is time to begin movement of the second puller 14. A signal is transmitted from the puller controller 204 to the second puller drive means 69 through a control line 228. The second puller drive means 69 also incorporates a tachometer 230 and encoder 232 to track the location and speed of the second puller 14 (block 314 of FIG. 13*a*). The measurements and readings of the tachometer 230 and encoder 232 are communicated to the puller controller 204 through control line 228.

The second puller 14 approaches the first puller 12 changes direction and moves slightly slower down the extrusion line than the first puller until a limit switch 234 is triggered by the first and second pullers. This switch 234 indicates that the pullers are immediately adjacent to each other and in position for passing off the profile shape 64 (block 316 of FIG. 13*a*). Thereafter, the second puller 14 matches the speed and direction of the first puller 12 (block 318 of FIG. 13*b*). When the speed of the second puller 14 matches the speed of the first puller 12, as measured by the tachometers of each puller, 222 and 230, the puller controller 204 transmits a signal to the hydraulic cylinder 45 of the second puller 14 to grip the profile shape 64 through a control line 236. Extension of the push rod 53 of the hydraulic cylinder 45 causes the second puller jaws 37 and 39 to grip the profile shape 64. In addition, the puller controller 204 transmits a signal to the second puller drive motor 69 to begin application of the necessary pulling force through control line 228 (block 320 of FIG. 13*b*).

Figure 13B:
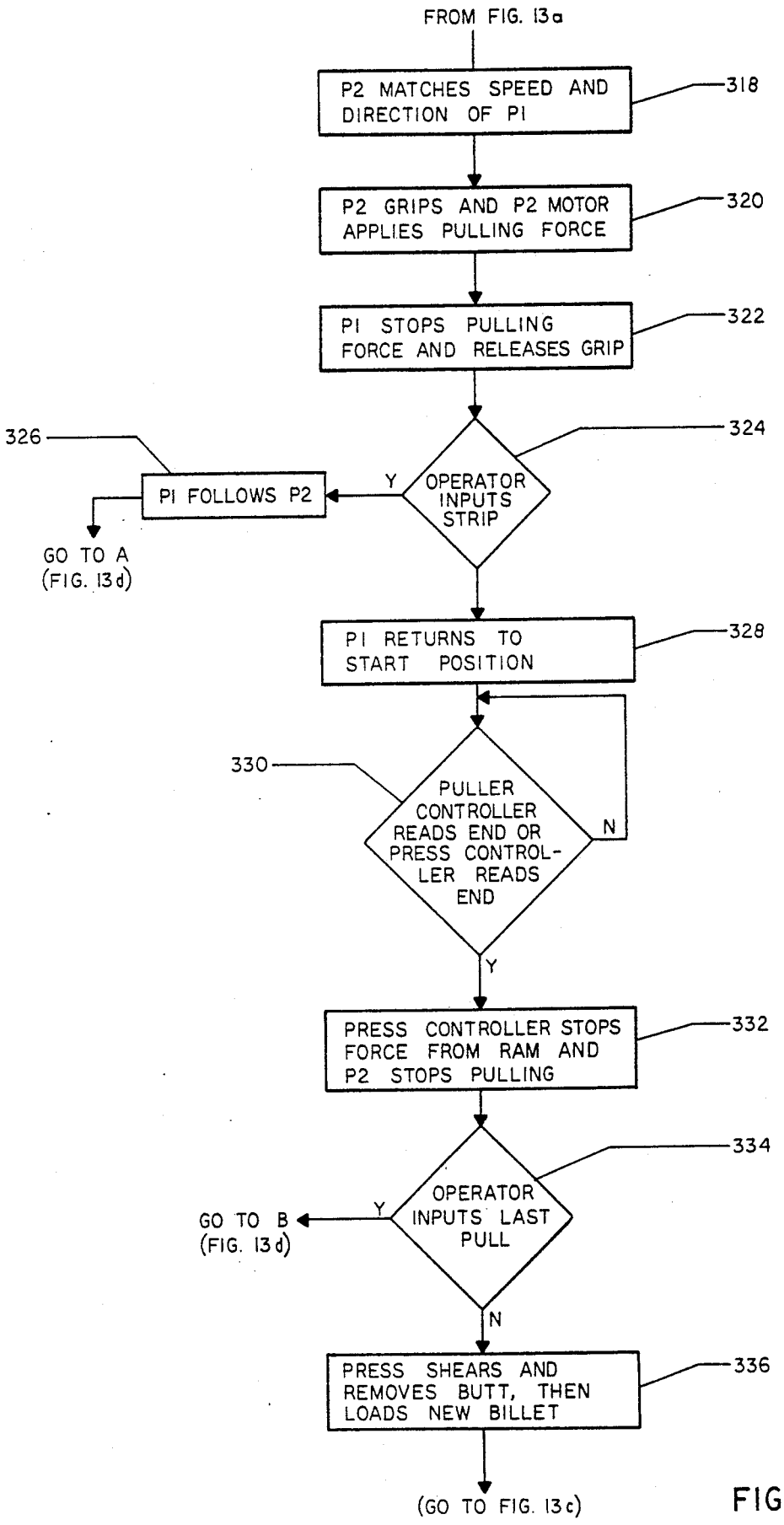

At the instant that the second puller 14 grips the profile shape 64, the first puller 12 releases its grip on the profile shape 64 and ceases applying pulling force (block 322 of FIG. 13*b*). The puller controller 204 transmits the signal to the first puller motor 68 to stop application of the pulling force and also transmits the signal to the hydraulic cylinder 44 to release the grip of the first puller jaws, 36 and 38, on the profile shape 64. The second puller 14 continues to pull the profile shape 64 down the extrusion line.

At this point, there are two options available, the operator can input a strip command from the console 208 (block 324 of FIG. 13*b*) or the first puller 12 can recycle and prepare for the next extrusion from the press 22 (block 328 of FIG. 13*b*). If the strip command is input, the cell controller computer 200 transmits a signal to the puller controller 204 which in turn transmits a signal to the first puller drive motor 68 to follow the second puller 14 along the extrusion line (block 326 of FIG. 13*b*) until the pullers are ready to strip the profile shape 64 from the press 22, which will be described below (see block 364 of FIG. 13*d*).

If the strip command is not input, the puller controller 204 transmits a signal to the first puller motor 68 to return the first puller 12 to its home position (block 328 of FIG. 13*b*).

As the second puller 14 continues down the extrusion line, the encoder 232 and tachometer 230 are tracking the relative position of the puller along the extrusion line and returning such information to the puller controller 204. Eventually, the second puller 14 will reach the pre-programmed extrusion length (block 330 of FIG. 13*b*). At this time, the puller controller 204 transmits a signal to the second puller motor 69 to stop, transmits a signal to the press controller 202 that the end of the extrusion has been reached, and transmits a signal to the press controller 202 to stop application of force from the ram 58 (block 332 of FIG. 13*b*). At this point, the operator may input the strip command into the console 208 (block 334 of FIG. 13*b*) and the profile shape will be stripped from the die 60 as described below. (See block 360 of FIG. 13*d*). If the strip command is not input, the press controller 202 transmits a signal to the press 22 to shear off and remove the butt 66 (block 336 of FIG. 13*b*). Thereafter, a second billet 63 is loaded into the billet cavity 56, when the second billet 63 is fully loaded, the press limit switch 210 is triggered (block 338 of FIG. 13*c*) and the press controller 202 transmits a signal to the press 22 to begin extruding the second billet 63 and transmits a signal to the puller controller 204 that extrusion has resumed.

Figure 13C:
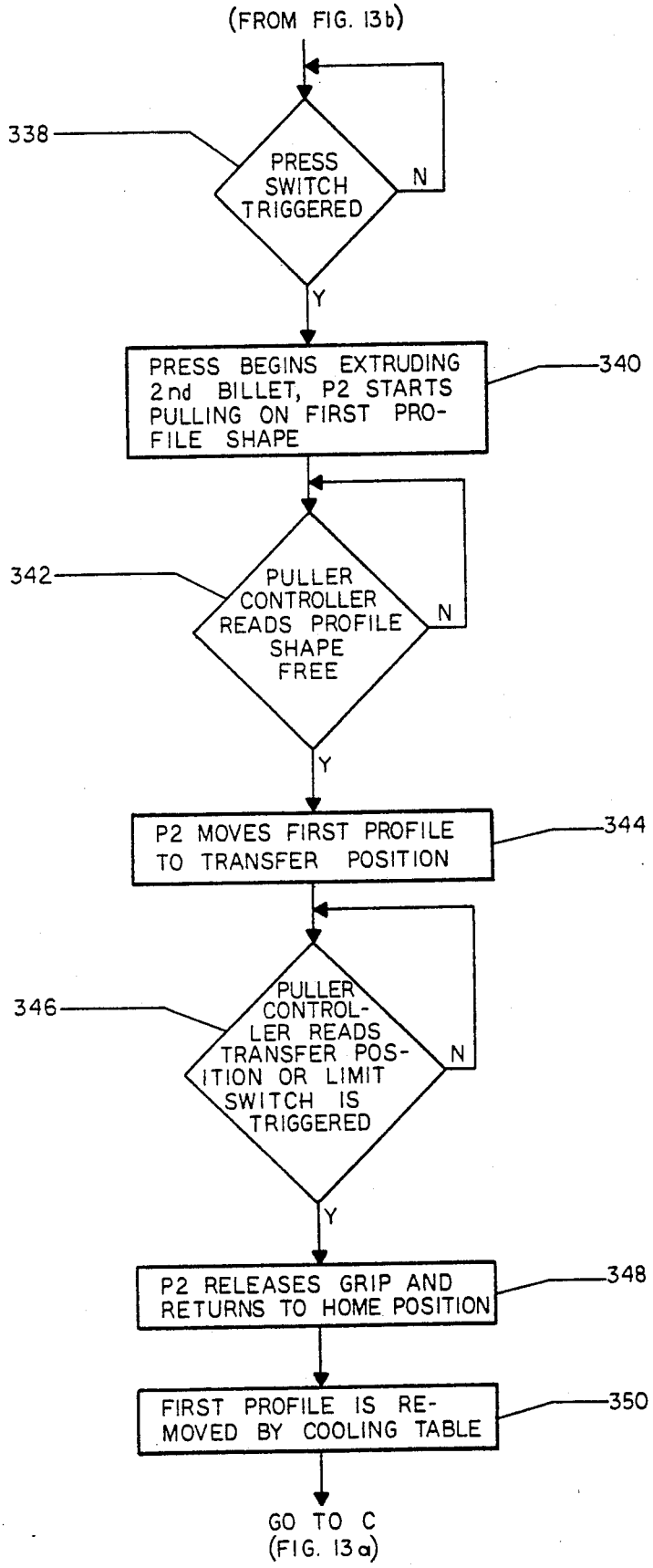

When the press starts to extrude the second billet, the press controller 202 transmits a signal to the puller controller 204 to begin reapplying pulling force to the profile shape 64 (block 340 of FIG. 13*c*). Through the combined force of the ram 58 and the second puller 14, the profile shape 64 created from the first billet is freed from the press 22. The tachometer 230 and encoder 23 of the second puller motor 69 will detect when the profile shape 64 is free from the die 60, (block 342 of FIG. 13*c*) at this time the puller controller 204 transmits a signal to the second puller motor 69 to adjust the speed and pulling force to transfer the profile shape to the cooling and conditioning operations (block 344 of FIG. 13*c*).

When the puller controller 204 determines that the second puller 14 has reached the necessary transfer position through input from the encoder 232 (block 346 of FIG. 13*c*), then the puller controller 204 transmits a signal to the second puller motor 69 to stop movement of second puller 14 and the hydraulic cylinder 45 to release its grip on the profile shape 64 through puller jaws 37 and 39. The profile shape 64 is removed from the extrusion line by the cooling table (not shown) and the second puller 14 returns to its home position and prepares to receive the next extrusion from the first puller 12 (block 348 and 350 of FIG. 13*c*). This entire operation (blocks 302 through 350) may be repeated to produce numerous extruded profile shapes 64.

Using the two pullers, 12 and 14, to strip the profile shape from the die allows for efficient removal of the extrusion from the die. If the operator had not input the strip command when the first puller 12 passed the profile shape 64 to the second puller 14 (block 324 of FIG. 13*b*) then the first puller would have returned to its home position adjacent to the die (block 328 of FIG. 13*b*). Therefore when the strip command is ultimately input, it is necessary to send the first puller 12 to the end of the extrusion line to work with the second puller 14 to strip the profile shape 64. Therefore, the puller controller 204 transmits a signal to the first puller motor 68 to move the first puller 12 down the extrusion line (block 362 of FIG. 13*d*) until the puller limit switch 234 is tripped (block 364 of FIG. 13). When the switch is tripped, the puller controller 204 transmits a signal to the first puller 12 to match the speed and direction of the second puller 14 (block 364 of FIG. 13*d*). At this time, the first and second pullers, 12 and 14, are interlocked and ready to strip the profile shape.

Figure 13D:
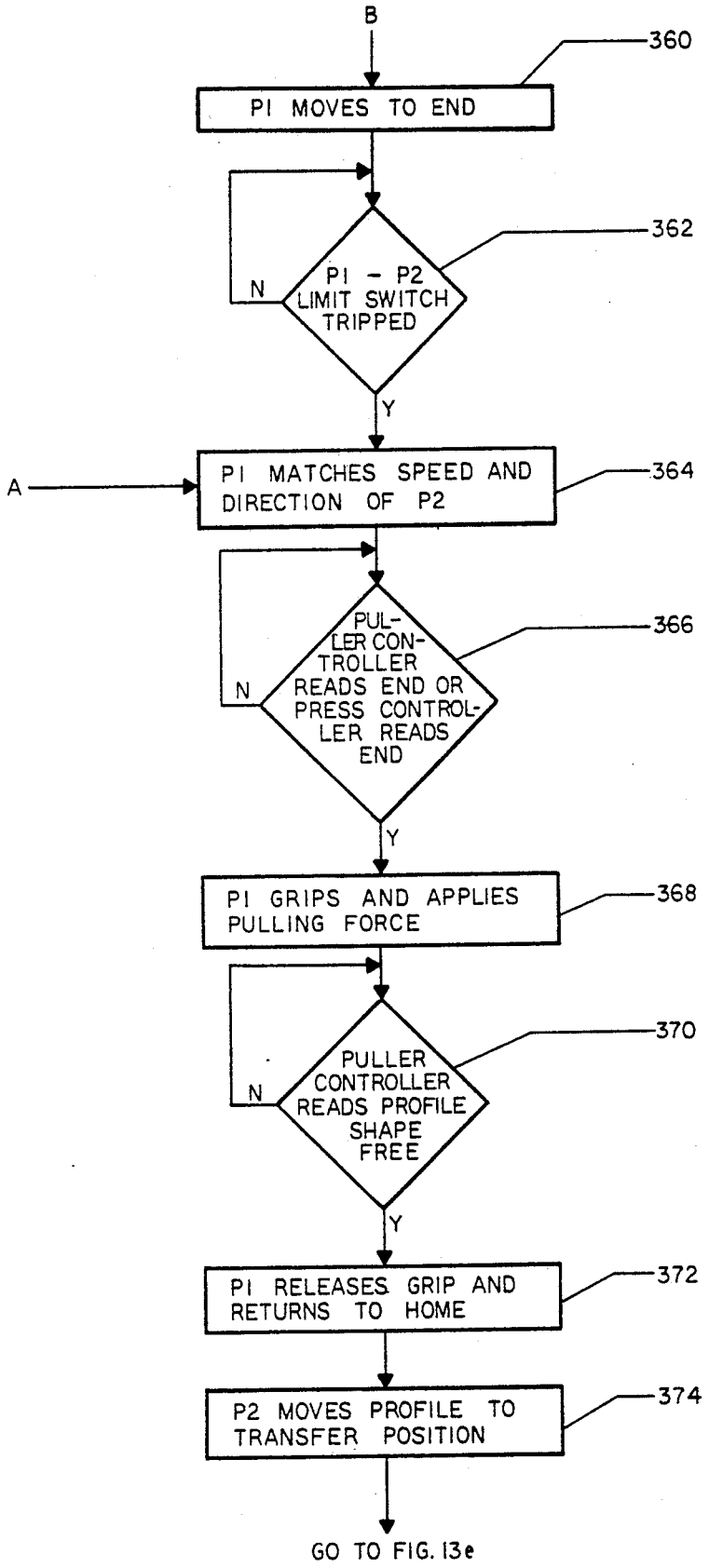

When the second puller 14 reaches the end of the extrusion pull, as determined by the puller controller 204 from input by the encoder 232 and tachometer 230 (block 366 of FIG. 13*d*) the puller controller 204 transmits a signal to grip the profile shape and begin applying pulling force (block 368 of FIG. 13*d*). The hydraulic cylinder 44 extends push rod 52 causing the jaws 36 and 38 of the first puller 12 to grip the profile shape 64 and the first puller motor 68 imparts a pulling force. The combined pulling force of the first and second pullers 12 and 14 strips the portion of the first billet remaining in the die 65 from the die 60. The puller controller 204 senses that the profile shape is free from the die through the input from the encoder 232 (block 370 of FIG. 13*d*). The puller controller 204 transmits a signal to the hydraulic cylinder 44 to retract push rod 52 and allow the jaws 36 and 38 to release their grip on the profile shape and the first puller motor 68 to return the first puller 12 to its home position (block 372 of FIG. 13*d*).

Figure 13E:
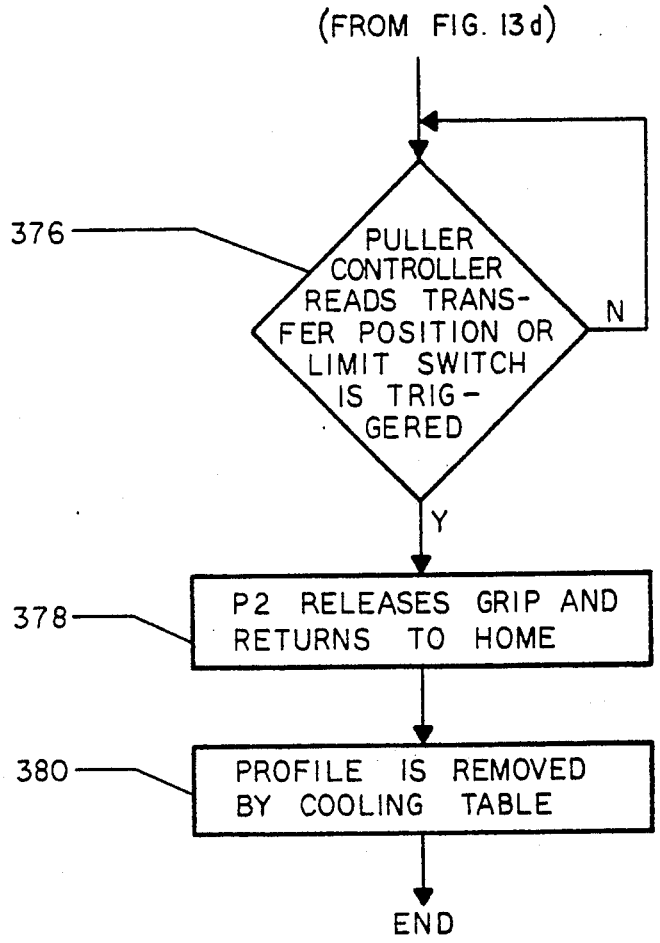

The second puller 14 continues to pull the profile shape along the extrusion line until the puller controller 204 determines that the transfer position has been reached from the input of the encoder 232 (block 376 of FIG. 13*e*). When the second puller 14 reaches this position, the puller controller 204 transmits a signal to the hydraulic cylinder 45 to release its grip on the profile shape 64 and the second puller motor 69 to return the second puller 14 to its home position (block 378 of FIG. 13*e*). Finally, the profile shape 64 is removed by the cooling table (not shown) for further conditioning, if necessary (block 380 of FIG. 13*e*).

The cell controller computer 200, controllers 202 and 204, operator console 208, limit switches 210 and 234, control lines, tachometers, 222 and 230, and encoders, 224 and 232, incorporated in the invention are all commercially available products.

The invention creates certain advantages not previously known in the prior art for a more efficient and inexpensive extrusion operation. The primary benefit achieved by the invention is increased efficiency of the extrusion press through coordination of the two pullers 12 and 14. Previously, regardless of the type of die 60 utilized, it was necessary to stop the puller and therefore stop the progress of the extruded profile 64 while the butt 66 was being removed and a second billet 63 was being loaded into the billet cavity 56. This step was necessary because the size of the puller typically used to extrude the profile shape 64 did not have sufficient pulling capacity to strip the profile 64 from the die 60 and the added force from the ram 58 was needed. The operation could proceed once the ram 58 forced the remaining portion of the first billet 65 out of the die. When the remaining portion of the first billet 65 cleared the die, then the puller could transfer the shape for further operations on the cooling table (not shown). Next, the puller would have to return, as quickly as possible, back to a point near the extrusion press 22 and prepare for receiving the profile shape 64 of the second billet 63.

The coordinated use of two lightweight pullers, 12 and 14, to supply the large amount of force necessary to strip the profile shape 64 from the extrusion die 60 eliminates the necessity of stopping the progress of the pullers while the next billet is being loaded because the force supplied by the ram 58 is no longer necessary to strip the profile. Secondly, by using two pullers, the second puller 14 completes any necessary further transfer of the profile 64 while the first puller 12 returns in preparation for further extrusion operations. In addition, use of two lightweight pullers, 12 and 14, is more cost effective than incorporating a single, considerably more powerful and expensive puller to supply the necessary force to strip the extrusion from the die 60. The efficiencies created by this invention result in substantial productivity increases of the extrusion apparatus, over the extrusion equipment known heretofore.

The benefits achieved by this invention are also appreciated when the extrusion operation incorporates quenching means for the profile shapes upon extrusion from the die. As seen in FIG. 14, quenching means 94 can be provided immediately after the profile shapes 64 exit the extrusion die 60. The quenching means can take many forms such as a plurality of spray heads 96 which direct a suitable cooling means such as air or water upon the profile shapes 64 as it exits the extrusion die 60. In addition, quenching means such as a quench tank (not shown) may be incorporated in the extrusion operation to replace the cooling table (not shown).

The benefit of the invention with respect to such quenching means 94 is the elimination of the necessity of stopping the progress of the extrusion of the profile shapes 64 from the die 60 while waiting for the force of the ram 58 to be reapplied to the billet 62 to strip the profile shape. If the progress of the profile shapes 64 through the quenching operation is stopped, then non-uniform properties could be created in the profile shapes 64 due to the excessive localized application of the cooling means by the spray heads 96. However, through the tandem pulling operation of the two pullers, 12 and 14, the extruded profile can be stripped from the die 60 immediately without slowing or stopping the extrusion operation and the extrusion is uniformly quenched. Likewise, unequal properties between the two ends of the profile shapes 64 can result when a quench tank (not shown) is incorporated as the quenching means. If the extrusion is halted to wait for the force of the ram 58 to be reapplied, there may be a significant temperature differential between the two ends of the profile shape 64 as it enters the quench tank (not shown), resulting in non-uniform properties along the length of the profile shape 64. Use of the two pullers, 12 and 14, to strip the profile shape 64 from the die 60 immediately will minimize any temperature differential between the ends of the profile shape 64.

While the preferred embodiment of the invention incorporates two pullers, 12 and 14, which move independently of each other, the invention can also achieve its advantages by incorporating two pullers which are linked mechanically through a suitable connecting arm or other means. An extrusion pulling apparatus of this configuration could not achieve the advantages obtained through the independent movement of the two pullers, but the ability to efficiently strip the profile shape from the billet immediately without incorporation of a single massive puller or without waiting for the force applied by the ram can still be achieved.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modification as incorporate those features which constitute the essential features of these improvements within the true spirit and scope of the invention.

I claim:

1. An apparatus for extruding profile shapes wherein an extrusion press has a billet cavity which has a first end, which is closed by a die, and an open second end, a ram moveable in the billet cavity between a loading position at the open second end and an extended position adjacent to the die wherein a butt end of a billet remains in the billet cavity and the die when the ram reaches the extended position; a shear means for severing the butt of the billet; an extrusion run-out table extending from the extrusion press along an extrusion line which is adapted to support profile shapes extruded from the press; first and second extrusion pullers, each which are adapted to grip and pull profile shapes from the extrusion press along an extrusion line; and control means for controlling the operation of the first and second extrusion pullers, the improvement comprising:

the control means comprises means for actuating the first and second extrusion pullers to simultaneously grip the profile shapes and pull the profile shapes to strip the profile shapes from the die.

2. An apparatus for extruding profile shapes according to claim 1 and further comprising means for controlling the force applied by the extrusion ram and controlling the first and second extrusion pullers to grip the profile shape in response to the application of said force.

3. An apparatus for extruding profile shapes according to claim 2 wherein the first and second extrusion pullers are controlled so that only one of said pullers grips and pulls the profile shapes until it is desirable to strip the profile shape from the die.

4. An apparatus for extruding profile shapes according to claim 1 wherein the first and second extrusion pullers are controlled so that only one of said pullers grips and pulls the profile shapes until it is desirable to strip the profile shape from the die.

5. A method for extruding profile shapes from an extrusion press wherein the shapes are extruded from a billet through a die opening by a ram within a billet cavity in an extrusion press, the ram being moved from a receiving position to an extended position near the die opening during the extrusion process and a butt end of a billet remaining in the die when the ram reaches the extended position, the butt end being sheared off by a shear within the press, the method comprising the steps of:

gripping the profile shapes by a pair of extrusion pullers subsequent to the steps of shearing off the butt end of the billet and pulling the profile shapes with such force that the profile shapes are stripped from the die.

6. A method for extrusion pulling according to claim 5 and further comprising the step of gripping the profile shapes and pulling the same from the die opening with only one extrusion puller as the ram extrudes the profile shapes.

7. A method for extrusion pulling according to claim 6 and further comprising the step of gripping the profile shapes by the second extrusion puller without exerting a pulling force on the profile shapes as the ram extrudes the profile shapes.

8. A method for extrusion pulling according to claim 7 and further comprising the step of releasing the grip of one of the pullers on the profile shapes and moving said one puller to a position adjacent to the die opening after the profile is stripped from the die.

9. A method for extrusion pulling according to claim 8 and further comprising the step of moving the second puller away from the die opening of the press as the first puller moves to the position adjacent to the die opening to continue to pull the profile shape away from the die opening.

10. A method for extrusion pulling according to claim 9 and further comprising the steps of releasing the grip of the second puller on the profile shape and moving the second puller to a home position.

* * * * *